United States Patent [19]

Garto et al.

[11] 4,095,794

[45] Jun. 20, 1978

[54] BALL DROP AND ELECTRICAL READOUT ROTATING RECEPTACLE HAVING A VACUUM CONDUIT BALL RETURN

[76] Inventors: Joseph Benjamin Garto, 2240 E. 8th St., Brooklyn, N.Y. 11223; Anthony Garto, 2075 Shore Pkwy., Brooklyn, N.Y. 11214; Alfred Garto, 2075 E. 16th St., Brooklyn, N.Y. 11229

[21] Appl. No.: 773,196

[22] Filed: Mar. 1, 1977

[51] Int. Cl.[2] ..... A63F 5/02; A63F 7/02

[52] U.S. Cl. ..... 273/101; 273/105.2; 273/142 A; 273/142 B; 273/142 E

[58] Field of Search ..... 273/138 A, 95 C, 101, 273/102.1 R, 102.1 C, 102.1 G, 102.2 R, 102.2 A, 103, 105 R, 105 A, 142 R, 142 A, 142 B, 142 C, 142 D, 142 E, 142 F, 142 G, 144 R, 144 A, 144 B, 120 A, 121 R, 121 A, 121 D, 122 R, 122 A, 123 A, 124 R, 124 A; 35/19 R

[56] References Cited

U.S. PATENT DOCUMENTS

| | | | |
|---|---|---|---|
| 1,892,113 | 12/1932 | Morgan | 273/102.2 R |
| 2,555,777 | 6/1951 | Benker | 273/138 A |
| 2,618,486 | 11/1952 | Durant | 273/121 A |
| 2,660,434 | 11/1953 | Durant | 273/121 A |
| 4,036,497 | 7/1977 | Garto et al. | 273/101 |

FOREIGN PATENT DOCUMENTS

| | | | |
|---|---|---|---|
| 494,398 | 3/1930 | Germany | 273/142 B |
| 1,451,032 | 9/1976 | United Kingdom | 273/142 D |

*Primary Examiner*—Richard C. Pinkham
*Assistant Examiner*—Arnold W. Kramer
*Attorney, Agent, or Firm*—Martin Smolowitz

[57] ABSTRACT

The token return assembly cooperates with an amusement apparatus formed of a token supply receptacle with a latchable lower portion and containing a vacuum supply unit; a rotating drum positioned on a base disposed below the receptacle, has openings for receiving tokens, as they fall from the receptacle caused by movement of the lower portion of the receptacle; an associated display panel electrically connected to switches below the openings, corresponding to positions of the tokens in the respective openings, the display being energized through the closing of normally open switch contacts by action with respective tokens. The switches, mounted on movable support plates associated with solenoids within the lower portion of the drum, on actuation of the solenoids by the player activating a token return switch, are withdrawn from the openings. The tokens, falling into an inclined channel which leads to a conduit are returned to the receptacle by vacuum suction. The lower portion of the receptacle is urged closed by a pusher member simultaneously with energization of the solenoids and initiation of the vacuum suction.

13 Claims, 6 Drawing Figures

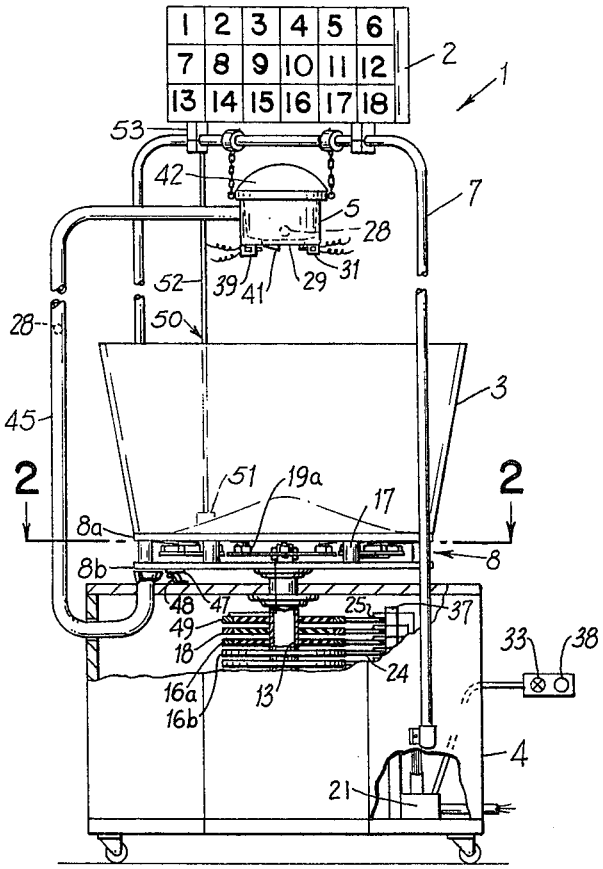
FIG. 1
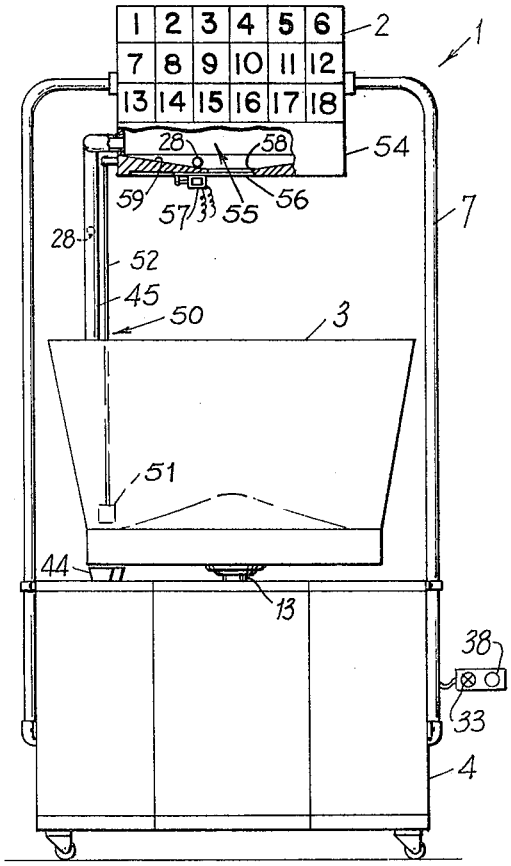
FIG. 6
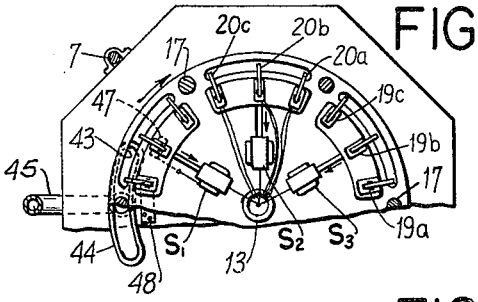
FIG. 2
FIG. 5
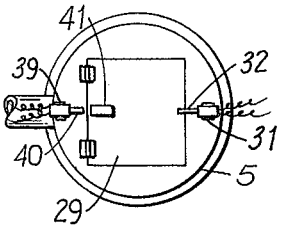
FIG. 3
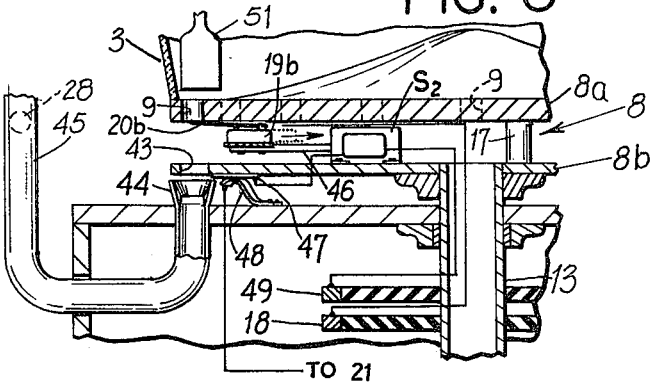
FIG. 4
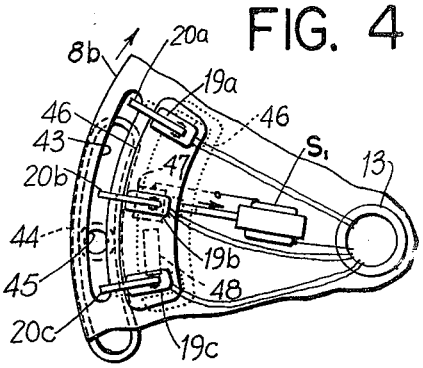

BALL DROP AND ELECTRICAL READOUT ROTATING RECEPTACLE HAVING A VACUUM CONDUIT BALL RETURN

The present invention is directed to an improved amusement apparatus defining a playing station employing a token receptacle, a rotating drum having positions for receiving tokens therein and an associated display panel electrically connected to switches within the drum for recording the positions of the tokens. More particularly, the present invention concerns itself with a number of improvements which when incorporated in an apparatus such as shown and described in U.S. Ser. No. 620,426, filed on Oct. 7, 1975, and now U.S. Pat. No. 4,036,497 entitled AMUSEMENT APPARATUS, results in a number of new and novel features permitting greater utilization of the apparatus without the need for substantial operator involvement.

In accordance with the apparatus of the type referred to in the above paragraph, the player, by energizing an electrical switch, causes one or more tokens to fall from an overhanging receptacle onto a rotating drum. The drum has a lower portion defined by an upper member having a series of openings for receiving the respective tokens and cooperating lower member formed as part of the lower surface of the drum being provided with electrical switches, each of which correspond to respective openings in the upper member. Once the tokens attain a rest position in the openings of the drum, the respective switches are energized and a designated position on a display panel identifies the at rest position of the respective tokens.

It has been observed that with such an arrangement, there are a number of shortcomings which tend to increase the amount of time an operator must spend aside monitoring the playing cycles, in order to permit continuous and uninterrupted playing action. For example, once the position of the tokens has been registered, the operator must physically remove the tokens from the rotating drum, manually latch the lower portion of the receptacle and manually place the tokens back into the receptacle to enable player action to begin again. This is all time consuming and necessitates that the operator either have an assistant or carry out the aforementioned on his own, thus reducing the continuous use of the apparatus.

Another shortcoming involves the overhanging receptacle for holding the tokens which fall into the drum. From a simplicity of design point of view, the elimination of the overhanging receptacle and associated mounting hardware would tend to reduce the number of parts which need be maintained, reduce the cost of the apparatus, increase the life of the operative parts and increase the mobility of the apparatus. The present invention contemplates structure for achieving this without loss of the basic function of the apparatus.

The principal features of the present invention are directed to an improved apparatus employing one or more token means which are caused to be released and fall by gravity from an opening formed in a token means supply compartment by movement of closure means of said compartment from a closed to an open position, said token means proceeding to spaced locations formed in a rotatable receptacle disposed below said token means supply compartment; said spaced locations being formed to receive said tokens after attaining a rest position in a lower surface of a rotatable receptacle; normally open switch means disposed at each of said spaced locations for causing the position of said tokens in said rotatable receptacle to be shown on a display means electrically connected to said switch means and responsive to engagement of said switch means to a closed position during the presence of token means at said spaced locations; said apparatus being provided by supply compartment switch means disposed in working relation to said closure means, for urging said closure means to return to the closed position after release of said token means; moveable support means disposed upon the lower surface of said rotatable receptacle, having said normally open switch means affixed thereto, for moving said switch means out of position with respect to said spaced locations and permitting said token means to proceed beyond said spaced locations under gravity action into channel means formed beneath said rotatable receptacle; conduit means extending from said channel means into said token means supply compartment for forming a continuous line of passage from a point proximate to said spaced locations to said token means supply compartment; and pressure forming means acting within said line of passage, for developing a pressurized fluid stream therein, whereby said token means are caused to be drawn into said fluid stream from said channel means and advanced upwardly into said token means supply compartment.

Also within the scope of the invention are features directed to pressure forming means being disposed within said token means supply compartment for development of a pressurized fluid stream within said line of passage extending from said supply compartment through said conduit means to said channel means, said pressure forming means being activated simultaneously with the energization of said pusher relay means for closing said supply compartment by said closure means and energization of said relay means for moving said support plate away from said entrance means, thereby permitting said token means to be drawn into said fluid stream for passage to said supply compartment.

Accordingly, it is the main object of the present invention to overcome the defects of the prior art.

Still another object is to provide a new and novel token return system enabling the tokens to be returned through the use of a vacuum arrangement by suction, whereby the tokens are drawn from their depository in the drum after falling therein to their initial starting position.

Still another object of the present invention is to provide switching means by which player is able to automatically cause the return and latching of the lower member of the receptacle simultaneous with the energization of electrical circuitry to permit the tokens to automatically proceed from a rest position in the drum to their start position without the need for manual placement by an operator.

Still a further object of the present invention is to provide electrical switching circuitry for selective operation with respect to each opening in the drum lower surface causing tokens at their rest positions to fall and be drawn into the token return system responsive to energization of switch means controlled by the player.

Further objects and advantages of the present invention will be more readily understood with respect to the accompanying specifications, claims and drawings.

IN THE DRAWINGS

FIG. 1 is a side elevational view of the invention in partial cross section.

FIG. 2 is a partial sectional plan view taken along lines 2—2 of FIG. 1.

FIG. 3 is a partial view of the lower portion of the invention in cross section.

FIG. 4 is an enlarged plan view of one moveable support plate and associated members.

FIG. 5 is a bottom view of the receptacle shown in FIG. 1.

FIG. 6 is a side elevational view partially in cross section of an alternate embodiment of the invention.

Numerical references are employed indicating various parts shown in the drawings and like numerals indicating like parts throughout the various figures of the drawings.

The apparatus 1, in FIG. 1, contemplates an apparatus 1 of the type generally shown and described in U.S. patent application Ser. No. 620,426 filed on Oct. 20, 1975, and now U.S. Pat. No. 4,036,497 entitled AMUSEMENT APPARATUS.

In accordance with the present invention, however, a fresh number of significant features have been incorporated in the apparatus. Each playing station is separately connected to its own single display device 2, instead of a single display device being electrically connected to each of several operating stations. The display device 2, in FIG. 1, reflects the totality of positions of tokens 28 in a single playing apparatus 1, rather than an integrated display for several stations.

The essential operation of each playing station apparatus 1, of the preferred embodiment is identical; with the intent being to have a player, by energization of a start switch 33, cause the end member 29 of an overhead receptacle 5 to move and permit tokens 28 to freely fall into a rotating drum 3 mounted upon base 4 and positioned underneath the receptacle 5. A hollow shaft 13 is connected to the drum 3 and extends through to lower member **8*b* of lower section 8 of the drum. The lower section 8 is formed of two main portions, namely upper member 8*a* in spaced relation to lower member 8*b*. The respective upper and lower members are held apart by spacers 17. Once the tokens 28 are at rest within openings 9 provided on the upper member 8*a*, lower section 8 of the drum 3, appropriate switches 19 in circuit with display device 2 and disposed on lower member 8*b* for alignment with openings 9, energized and the display device 2 records each of the positions of the tokens 28**.

As clearly shown in FIG. 1, the player, by energizing start switch 33, causes a solenoid 31 mounted at the edge of pivotable end member 29 of the receptacle 5 to retract an associated latch 32, dropping the end member 29 and permitting the tokens 28 to fall into the rotatable drum 3. After the tokens 28 have come to rest within the openings 9 in the drum 3, the positions of the tokens 28 are recorded on the display device 2 through the energization of switches 19 associated with each of the respective openings 9. This occurs since each switch 19 is sufficiently sensitive to be able to close through the weight of the respective tokens 28 on the normally open switch contacts 20, which causes energization of display device 2 corresponding to the token rest position in opening 9. Once this has occurred, a given play is over and the player is now prepared to cause the tokens 28 to return to their initial position in the receptacle 5 and start a fresh playing operation.

The player, by energizing a token return switch 38 (see FIG. 1) simultaneously initiates a sequence of events which ultimately cause the tokens 28 to return to their initial start position in receptacle 5. Solenoid 39 (see FIG. 5) having affixed thereto an extendable pusher member 40, disposed in proximity to the pivot point of end member 29 of the receptacle 5, is energized causing the pusher member 40 to extend in the forward direction and communicate with a wedge shaped abutment 41 disposed on end member 29. In turn, the forward momentum generated by the pusher member 40 on abutment 41, advances the end member 29 to its original engaged position with latch 32 of solenoid 31. A pressurized fluid system employed to return the tokens 28 to receptacle 5 is energized through the use of a motor driven suction unit 42 mounted internal of the receptacle 5. Lastly, as shown in FIG. 2, as the electrical circuit to the respective solenoid switches *s*1, *s*2, *s*3, etc., mounted on lower member **8*b* of drum 3 is energized, the respective contacts 20*a*, 20*b*, 20*c*, etc. of each of the respective switches 19*a*, 19*b*, 19*c*, etc. at a designated point in time, are urged to move inwardly, as explained hereinafter, permitting the tokens 28 to pass through arcuate opening 43 in lower member 8*b* of drum 3. An inclined channel 44 (see FIG. 3) below the opening 43, receives the tokens 28 from whence they, in turn, are caused to move into a conduit 45 which extends out of the base 4 and upward to the receptacle 5. The vacuum system, as explained hereinafter, directs the movement of the tokens 28 through the conduit 45 to the receptacle 5**.

The respective switch contacts **20*a*, 20*b*, 20*c*, as shown in FIGS. 2 and 4, are formed as part of a series of switches 19*a*, 19*b*, 19*c*, etc. mounted upon respective moveable support plates 46 disposed on lower member 8*b*** which in turn are connected to respective solenoids *s*1, *s*2, *s*3. The switches **19*a*, 19*b*, 19*c*, etc. are at designated arcuate distances from one another above openings 43 in lower member 8*b*. The respective positions of the contacts 20*a*, 20*b*, 20*c*, etc. are in alignment with openings 9 of upper member 8*a* of the rotatable drum 3. In other words, for every opening 9 in upper member 8*a*, there exists a corresponding normally open switch contact 20*a*, 20*b*, 20*c*, etc. positioned therebelow having contacts extending across and beneath an opening 9**.

The switches **19*a*, 19*b*, 19*c*, etc. are spaced apart below openings 9 of upper member 8*a*, along an arcuate path and have contacts 20*a*, 20*b*, 20*c*, etc. that centrally bisect the respective openings 9; also, the contacts 20*a*, 20*b*, 20*c*, etc. extend above the arcuate opening 43 formed on the lower member 8*b*. As shown in FIG. 4, switches 19*a*, 19*b*, 19*c*, etc. are mounted out of the path of the arcuate opening 43 permitting tokens 28 to fall through into the channel 44 once the moveable contacts 20*a*, 20*b*, 20*c*, etc. retract. However, up until the token return switch 38 is energized, the action of a token 28 on the normally open switch contacts 20*a*, 20*b*, 20*c*, etc. only energizes the display device 2 by urging respective moveable contacts downwardly to complete the switch circuit (see FIG. 3). Each of the switches 19*a*, 19*b*, 19*c*, etc. are mounted on plate 46 and are positioned at a point near the arcuate shaped opening 43 in the lower member 8*b***.

As shown in more detail in FIGS. 2 and 3, the lower section 8 of the rotatable drum 3 is essentially a composite member having an upper member **8*a* and a lower member 8*b* each being held spaced apart from one another by suitable spacers 17. The upper member 8*a* is provided with the series of equally spaced openings 9, where for each opening there are corresponding switches 19***a*, 19*b*, 19*c*, etc. having contacts 20*a*, 20*b*, 20*c*, etc. which are in alignment with each of the respective openings 9. Each switch 19*a*, 19*b*, 19*c*, etc. is connected to an associated insulated ring 16, i.e., *a*, *b*, *c*, etc. and to ring 18, such electrical wiring taking place through a passageway in shaft 13 (see FIG. 1). Ring 18 provides the control voltage from terminals 21 for energizing the display device 2 through switches 19*a*, 19*b*, 19*c*, etc. and associated rings 16, i.e., *a*, *b*, *c*, etc. via corresponding wiper 24 and contact 25 through wires 26 connected to lamps in display device 2. Each ring 16 is provided with associated wiper members 24 positioned on a wiper mounting assembly 37 and corresponding insulated contacts 25 that are electrically connected to a plurality of positions each illuminated corresponding to a designation through energization of switches 19*a*, 19*b*, 19*c*, etc.

As shown in FIG. 3, solenoids *s*1, *s*2, *s*3 are in electric circuit relation with corresponding contact plates 47 disposed at designated intervals at the under surface of the lower member 8*b*, are energized as the drum 3 rotates and the respective contact plates 47 are caused to communicate by wiping action against a fixed electrically hot shoe 48. It follows during operation, when the player initiates the return token cycle, through energization of token return switch 38, the hot shoe 48 is in circuit relation with the respective solenoids *s*1, *s*2, *s*3 as each corresponding contact plates 47 of solenoids *s*1, *s*2, *s*3 pass and wipe hot shoe 48. At this point, the respective solenoid circuits are made, causing each energized solenoid to retract for a prescribed distance and the switch contacts 20*a*, 20*b*, 20*c* (see FIG. 2) connected through switches 19*a*, 19*b*, 19*c*, etc. to support plate 46 to move away from the opening 43 and the tokens 28 to fall.

The common electrical leads of each of the respective solenoids *s*1, *s*2, *s*3 are connected together and are directed through the hollow shaft 13 to insulated ring 49. The hot leads of each of the solenoids *s*1, *s*2, *s*3 are each connected to an associated contact plate 47 mounted on the under surface of the lower member 8*b*. The ring 49 in turn is in electrical circuit relation to terminals 21 through mounting assembly 37 connected via insulated wiper 24 and contact 25.

Each solenoid *s*1, *s*2, *s*3 is directly connected to a contactor plate 47 mounted therebelow. The fixed upwardly biased hot shoe 48 is mounted to the base of the drum 3 beneath the respective solenoids and in proximity to arcuate opening 43 and communicates with each of the contact plates 47 only when the lower member 8*b* of the drum 3 passes-by the shoe 48. The hot shoe 48 is directly wired to terminal 21 routed external of the base 4 of drum 3.

According to FIG. 3, a series of openings 43 beneath each of the extendable switch contacts 20*a*, 20*b*, 20*c*, permits the tokens 28, as they are released, to travel by gravity down an inclined channel 44 and through to a tubular conduit 45 which is pressurized through the action of a motor driven vacuum unit 42 placed in the line of the conduit 45 and disposed in the receptacle 5. The conduit 45 is in airtight relation to the receptacle 5 and, thusly, under negative pressure, the tokens 28 are sucked out of the lower portion of conduit 45 through the base 4 and drawn into its start position in the receptacle 5. The channel 44 leading to conduit 45 in base 4 of drum 3 is oriented at an incline to the vertical enabling the tokens 28 to proceed in sequence, one after another, through the openings 43 in lower member 8*b*. In order to monitor the token return operation, the conduit 45 is constructed of a clear plastic material, such as Lucite. Obviously, other materials may be suitably employed providing there is sufficient clearance on the inside of the conduit 45 to enable free movement of the tokens 28.

As the player maintains the token return switch 38 energized, the drum 3 will continue to rotate and the respective contact plates 47 of each of the solenoids *s*1, *s*2, *s*3 communicate with hot shoe 48 and an associated solenoid is energized causing it to retract moveable support plate 46. A cluster of switch contacts 20*a*, 20*b*, 20*c*, in turn, move in concert in response to the solenoid action. In other words, each of the solenoids *s*1, *s*2, *s*3 will sequentally cause the respective clusters of switches 19*a*, 19*b*, 19*c* to move and contacts 20*a*, 20*b*, 20*c* to retract for a prescribed distance every time the solenoid circuit is energized.

Thereafter, these same solenoids *s*1, *s*2, *s*3, as they travel away from the hot shoe 48, become deenergized by the deactivation of the associated contact plates 47 with the hot shoe 48, causing the solenoid switches to open, enabling the switches 19*a*, 19*b*, 19*c*, etc. to advance by movement of support plate 46 toward the openings 43 permitting associated contacts 20*a*, 20*b*, 20*c* to extend across such openings 43. The hot shoe 48 employed to wipe against the contact plates 47 is fixed in proximity to the inclined channel 44 leading toward the pressurized conduit 45. It follows, that the energization of the solenoids and resultant movement of the associated switch contacts, takes place when the tokens 28 are directly above the opening 43 leading to the inclined channel 44. As the solenoid circuit is made and the switch contacts 20*a*, 20*b*, 20*c* are out of the path of openings 43, the respective tokens 28 are able to pass therethrough and thence into the inclined channel 44, out of the base 4 by suction, and up to and into the receptacle 5.

As the player energizes the token return switch 38, the electrical circuit to the solenoid 39 acting on end member 29 of receptacle 5 is energized. As shown in FIG. 5, solenoid 39 has a pusher member 40 affixed to its working end beneath receptacle 5. Energization of solenoid 39 causes the pusher member 40 to advance from a normally retracted position to an outwardly extending position for a distance sufficient to engage the pivotally moveable end member 29 of the receptacle 5 through abutment 41. Prior to this time the end member 29 is free of the receptacle 5, after being released from its normally latched position via the player energizing start switch 33. By advancing from its normally retracted position, the pusher member 40 causes the end member 29 to latch at 32 with solenoid 31. Simultaneously with this action, the suction unit 42 starts to draw and suction is provided in the conduit 45 line extending from the lower portion of the channel 44 through to the receptacle 5.

The motor driven suction unit 42 and the pusher member solenoid 39 are in electrical circuit relation with solenoids *s*1, *s*2, *s*3 for token return to the receptacle 5. All of which are activated through terminals 21 by token return switch 38. The solenoids *s*1, *s*2, *s*3; motor driven suction unit 42; and solenoid 39 are only operational during the time the token return switch is energized to complete the electrical circuit. Also, the player can monitor token movement and return during this operation. The time duration needed for the tokens 28 to drop into the channel 44 and for end member 29 of the receptacle 5 to latch into the closed position is sufficient to enable suction to develop in conduit line 45 for the tokens 28 to be drawn upwardly into the receptacle 5.

The invention also employs a vertically mounted mechanical wiper 50 having a moveable contact member 51 at its working end. The lower most portion of the contact member 51 is several inches above the upper member 8*a* of the lower section 8 of drum 3, so that it does not interfere with the rotation of the drum. The basic function of the wiper 50 is to gently touch the tokens 28 in the drum 3 so that any of the tokens 28 which may be sitting on the land areas between two adjacent openings 9 will be urged to move to an opening 9. The vertical position of the working end 51 of the wiper 50 with respect to upper member 8*a* of the drum 3 can be adjusted through position of rod 52 on a clamp 53 attached to frame 7, so to accomodate different sizes of tokens being employed.

FIG. 6 illustrates an alternate embodiment to the present invention employing a token supply facility 54 incorporated into the lower portion 55 of the display device 2. Release of the tokens 28 is accomplished through movement of a slidable member 56 formed at the lower portion 55, by actuation of solenoid 57 associated with the lower portion 55. The lower portion 55 is provided with inclined surfaces 59 of the supply facility 54, enabling the tokens 28 to proceed and to fall through opening 58 in lower portion 55, by gravity action, into rotating drum 3 situated directly below. According to this arrangement, the token return conduit 45 extends directly into supply facility 54 within the display device 2 from the base 4 of drum 3 instead of in the manner shown in FIGS. 1 and 3. A motor driven suction unit 42 (not shown), of the type previously mentioned, forms part of the token supply facility 54 and is employed for token return. With this particular embodiment, the need for a receptacle 5 and associated hardward is eliminated through the use of an integrated token storage and start facility formed as part of the display device 2.

It will be understood that other and further forms of the invention may be devised without departing from the spirit and scope of the appended claims.

What we claim:

1. An improved apparatus employing one or more token means which are caused to be released and fall by gravity from an opening formed in a token means supply compartment, by movement of closure means of said compartment from a closed to an open position, said token means proceeding to spaced locations formed in a rotatable receptacle disposed below said token means supply compartment; said spaced locations being formed to receive said token means after attaining a rest position in a lower surface of said rotatable receptacle; normally open switch means disposed at each of said spaced locations for causing the position of said tokens in said rotatable receptacle to be shown on a display means electrically connected to said switch means and responsive to engagement of said switch means to a closed position during the presence of token means at said spaced locations; said apparatus being provided by: supply compartment switch means disposed in working relation to said closure means, for urging said closure means to return to the closed position after release of said token means; moveable support means disposed upon the lower surface of said rotatable receptacle, having said normally open switch means affixed thereto, for moving said switch means out of position with respect to said spaced locations and permitting said token means to proceed beyond said spaced locations under gravity action into channel means formed beneath said rotatable receptacle; conduit means extending from said channel means into said token means supply compartment for forming a continuous line of passage from a point proximate to said spaced locations to said token means supply compartment; and pressure forming means acting within said line of passage, for developing a pressurized fluid stream therein, whereby said token means are caused to be drawn into said fluid stream from said channel means and advanced upwardly into said token means supply compartment.

2. An apparatus as claimed in claim 1, wherein: said moveable support means being disposed upon said lower surface of said rotatable receptacle, adjacent to entrance means formed in said lower surface; said support means having affixed thereto relay means energizable in response to the position of said token means with respect to said entrance means, whereby, said relay means when energized causes said support means to move for a prescribed distance with respect to said entrance means causing said switch means contacts to move away from said spaced locations, permitting the free fall of said token means from said spaced locations through said entrance means into said channel.

3. An apparatus as claimed in claim 2, wherein: said relay means being in electrical circuit relation with and energized by contact means disposed about the periphery of the under surface of the rotatable receptacle, for transmitting electrical energy to said relay means from a fixed conductor disposed in proximity to said channel means, rotation of said receptacle energizes said relay means circuit through the wiping action of said contact means with said fixed conductor, causing said moveable support means to retract said switch means away from said entrance means.

4. An apparatus as claimed in claim 2, wherein: said moveable support means being defined by normally open switch means affixed thereto provided with contact means extendable across associated spaced locations, said contact means forming a barrier for downward movement of said token means in associated spaced locations, until said switch means are urged to travel away from said entrance means.

5. An apparatus as claimed in claim 2, wherein: said entrance means being defined by a series of arcuate openings formed about the periphery of said lower surface of said rotatable receptacle, being disposed in alignment with said spaced locations and to said channel means, thereby providing a line of passage for said token means to said conduit means through said entrance means, during energization of said relay means.

6. An apparatus as claimed in claim 1, wherein: said moveable support means being provided with a purality of switch means corresponding to associated spaced locations affixed thereto, whereby, energization of said relay means causes said moveable support means to retract and said plurality of switch means thereby moves out of engagement with said associated spaced locations permitting free token means movement from respective spaced locations to said channel means.

7. An apparatus as claimed in claim 1, wherein: said support means being defined by several mounting plates disposed beneath said spaced locations, each having switch means affixed thereto corresponding in number to respective spaced locations; each of said several plates being moveable in response to extension and retraction of respective moveable contacts of said relay means associated with each of said several plates.

8. An apparatus as claimed in claim 1, wherein: said token means supply compartment closure being formed of a closely fitting member disposed at a lower surface of said compartment, moveable under the action of normally retracted pusher means disposed at the working end of relay means affixed in proximity to said lower surface of said token means supply compartment; said relay means being energized to cause said pusher means to continuously extend and engage said closure until a closure latching condition is attained after which said pusher means return to the retracted position.

9. An apparatus as claimed in claim 1, wherein: said pressure forming means being disposed within said token means supply compartment for development of a pressurized fluid stream within said line of passage extending from said supply compartment through said conduit means to said channel means, said pressure forming means being activated simultaneously with the energization of said pusher relay means for closing said supply compartment by said closure means and energization of said relay means for moving said support plate away from said entrance means, thereby, permitting said token means to be drawn into said fluid stream for passage to said supply compartment.

10. An apparatus as claimed in claim 9, including: token means return circuit means defined by electromotive means for energizing said pressure forming means, being in circuit relation with said token means compartment relay means and said relay means mounting said moveable plate members; contact means connected to said plate member relay means for selective energization of said relay means through communication of said contact means by conductor means connected to a source of electrical energy, and token return switch means in electrical circuit relation with said token return circuit for permitting a player to energize said circuit by actuation of said token return switch.

11. An apparatus as claimed in claim 10, wherein: said relay means for said token supply compartment closure means being in electrical circuit relation to said token means return circuit means.

12. An apparatus as claimed in claim 1, wherein: said token means supply compartment being formed integrally of said display means, said compartment having interior wall surfaces sloping toward a centrally formed opening in said display device above said rotatable receptacle, closure means disposed at the lower end of said compartment having affixed thereto relay means responsive to player action through switch means connected to said relay means, for urging said closure to move from a first compartment closed position to a second compartment open position, enabling said token means disposed therein, to freely fall into said rotating receptacle.

13. An apparatus as claimed in claim 1, wherein: said rotatable receptacle being provided with vertically adjustable guide means affixed to the upper portion of said apparatus depending into said receptacle to a point above said lower surface for engaging token means diposed in land areas adjacent spaced locations and urging said token means into spaced locations.

* * * * *